US008203422B2

(12) United States Patent
Naito et al.

(10) Patent No.: US 8,203,422 B2
(45) Date of Patent: Jun. 19, 2012

(54) RESISTOR DEVICE AND METHOD OF MANUFACTURING THE SAME

(75) Inventors: Takashi Naito, Ina (JP); Akihiko Nakamura, Ina (JP)

(73) Assignee: Koa Corporation, Ina-shi, Nagoya (JP)

( * ) Notice: Subject to any disclaimer, the term of this patent is extended or adjusted under 35 U.S.C. 154(b) by 723 days.

(21) Appl. No.: 12/272,137

(22) Filed: Nov. 17, 2008

(65) Prior Publication Data

US 2009/0134967 A1 May 28, 2009

(30) Foreign Application Priority Data

Nov. 22, 2007 (JP) ..... 2007-302983

(51) Int. Cl.
*H01C 1/012* (2006.01)

(52) U.S. Cl. ..... 338/308; 338/307; 338/334

(58) Field of Classification Search ..... 338/307, 338/308, 309, 333, 334
See application file for complete search history.

(56) References Cited

U.S. PATENT DOCUMENTS 3,803,528 A * 4/1974 Wellard ..... 338/257
4,016,527 A * 4/1977 Francis et al. ..... 338/274
4,634,514 A * 1/1987 Nishizawa et al. ..... 204/406
5,889,459 A * 3/1999 Hattori et al. ..... 338/9
6,317,024 B1 * 11/2001 Orii ..... 338/276

* cited by examiner

*Primary Examiner* — Kyung Lee
(74) *Attorney, Agent, or Firm* — Westerman, Hattori, Daniels & Adrian, LLP

(57) ABSTRACT

To provide a glazed metal film resistor device excellent in TCR characteristics with using an economical base body containing glass by reducing affection to TCR characteristics caused by glass contained in the base body. The resistor device comprises base body 11 containing glass, first protective film 12, which does not contain glass, formed on a surface of base body 11, and thick film resistor 13 formed on first protective film 12. By forming first protective film 12 on a surface of base body 11 containing glass and insulating base body 11 containing glass against thick film resistor 13 of ruthenium oxide as primary component, affection of glass contained in base body 11 to thick film resistor 13 of ruthenium oxide can be suppressed, and change of TCR value from original value of thick film resistor itself can be suppressed.

16 Claims, 2 Drawing Sheets

RESISTOR DEVICE AND METHOD OF MANUFACTURING THE SAME

BACKGROUND OF THE INVENTION

1. Field of the Invention

The present invention relates to a glazed metal film resistor device provided with a thick film resistor on an insulative ceramic base body such as alumina, and the thick film resistor is formed by coating a surface of the base body with a thick film resistor paste and firing.

2. Description of the Related Art

The glazed metal film resistor is a resistor, whose size is small and whose resistance value can be manufactured to a high resistance value region. The resistor is very stable against severe environments and overloads, and the resistor is widely used in various electronic equipments. The glazed metal film resistor is manufactured, for example, by coating a surface of a columnar insulator such as alumina with a thick film resistor paste and firing the paste to form a thick film resistor of ruthenium oxide as primary component on the surface of the columnar insulator (Japanese laid-open patent publication 6-310302).

The thick film resistor comprises, for example, ruthenium oxide ($RuO_2$) and glass, and it is known that as glass element increases, then resistance value of the thick film resistor becomes higher, and TCR value of the thick film resistor shifts to minus direction. Because of this fact, there is a problem that when the thick film resistor is formed on an insulator containing glass, the thick film resistor becomes to be affected by glass contained in the insulator, and the TCR value of the thick film resistor shifts to worse value from the original TCR value of the thick film resistor material ($RuO_2$) itself. Also, an amount of glass contained in the base body (insulator) is not always equal. Therefore, since effects of glass contained in the insulator to the thick film resistor differs by every base body (insulator), then it is quite difficult to form equal characteristics among resistor devices, which are manufactured by the same process. Also, since resistance value of the resistor is expected to be higher from the resistance value of the thick film resistor material ($RuO_2$) itself, then it is required to use more metal material than usual thick film resistor material.

The problem can be solved by using an insulator as a base body, which does not contain glass, however the insulator, which does not contain glass, is much expensive comparing to the insulator containing glass, and becomes a factor of cost increasing of the glazed metal film resistor device.

SUMMARY OF THE INVENTION

The present invention has been proposed in view of above mentioned affairs. An object of the present invention is to provide a glazed metal film resistor device, which is excellent in TCR characteristics with using an economical base body containing glass and by reducing influence to TCR characteristics caused by glass contained in the base body.

To attain the above object, the resistor device of the present invention is characterized by an insulative base body containing glass, a first protective film, which does not contain glass, formed on a surface of the base body, and a thick film resistor formed on the first protective film. Also, the method of manufacturing the resistor device of the present invention is characterized by preparing an insulative base body containing glass, forming first protective film of metal oxide on a surface of the insulator, coating the surface of the base body with thick film paste and firing the paste to form a thick film resistor, fitting electrode caps at both ends of the base body, on which the thick film resistor is formed, to connect the caps to the thick film resistor, and trimming the thick film resistor to adjust resistance value thereof.

According to the present invention, by forming the first protective film on a surface of the base body containing glass and insulating the base body containing glass against the thick film resistor of ruthenium oxide as primary component, influence of glass contained in the base body to the thick film resistor of ruthenium oxide can be suppressed. Then, change of resistance value and TCR value from original value of the thick film resistor itself can be suppressed. Therefore, a glazed metal film resistor device can be manufactured with using low cost base body containing glass, keeping the manufacturing cost low, having excellent TCR value, suppressing characteristics changes among many products, and suppressing usage amount of metal material used as resistor material.

Figure 1:
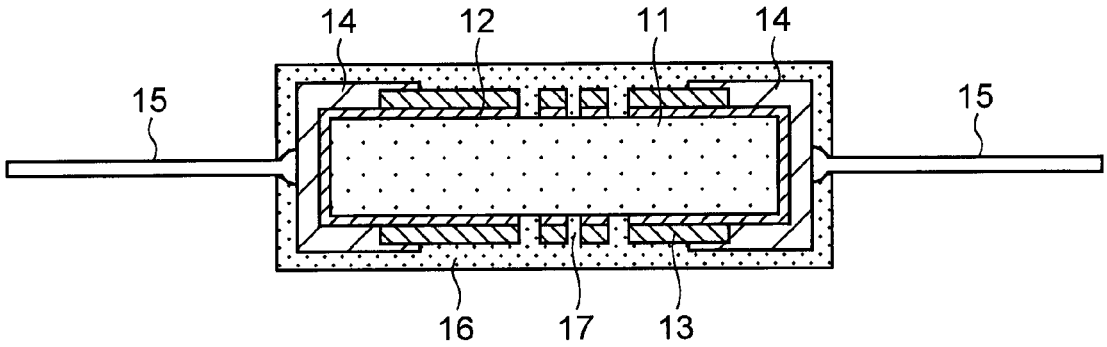
FIG. 1 is a cross-sectional view of a glazed metal film resistor device of an embodiment of the present invention taken along longitudinal axis of the resistor device.
Figure 2:
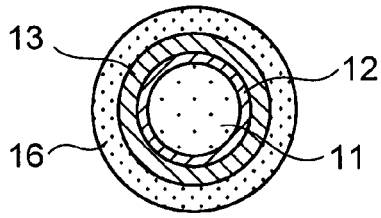
FIG. 2 is a cross-sectional view of the resistor device taken along a surface perpendicular to the longitudinal axis at center portion of the resistor device.

The above and other objects, features, and advantages of the present invention will become apparent from the following description when taken in conjunction with the accompanying drawings, which illustrate a preferred embodiment of the present invention by way of example.

DETAILED DESCRIPTION OF THE PREFERRED EMBODIMENTS

Preferred embodiments of the present invention will be described with referring to the attached drawings. Same or corresponding parts or elements are denoted by the same reference characters throughout the drawings.

Base body 11 is a columnar ceramic insulator, which comprises alumina and glass. The ratio of alumina/glass is 50/50, or 80/20, or so on. The insulator containing glass can be purchased at far lower cost comparing to an insulator, which does not contain glass. As the insulator, ceramics such as mullite, cordierite, and steatite can be used other than alumina, however, it is on the premise that base body 11 is a ceramic insulator containing glass.

First protective film 12 is a film of metal oxide, which comprises tin oxide as primary component formed on the entire surface of base body 11. Other than tin oxide, metal oxide such as nickel oxide, bismuth oxide, and/or so on are contained as additive component for improving insulating performance. Thickness of first protective film 12 is more than 0.1 μm for effectively suppressing diffusion of glass contained in the base body. Further, since it is considerable that spots of thick portions and thin portions can be formed through the film, it is more preferable that the thickness of first protective film 12 be formed more than 0.7 μm at least at a portion of the film 12 for ensuring stable insulating performance. There is no upper limit of the thickness of the film 12 for effectively suppressing diffusion of glass, approximately 4 μm is an upper limit under design considerations. Further, tin oxide is used as the first protective film, however metal oxide film other than tin oxide film can be used. As to condition for replacing metal oxide instead of tin oxide, it is preferable that metal oxide material can be endurable to heat for firing thick film resistor of ruthenium oxide as principal component, and the material does not extend influence to characteristics of thick film resistor of ruthenium oxide as principal component. As to preferable material, for example, $Bi_2O_3$, PbO, AgO, NiO, $SeO_2$, HfO, $Y_2O_3$, ZnO, MgO, $InO_2$, SrO, $Ta_2O_5$, $TeO_2$, CdO, $SiO_2$, $GeO_2$, $GaO_2$, $Al_2O_3$, $ZrO_2$, BaO, CaO can be listed. A kind of material or more than two kinds of material can be selected among the above for the first protective film.

Thick film resistor 13 is formed by mixing ruthenium oxide $RuO_2$ (or a mixture of ruthenium oxide $RuO_2$ as primary component and silver oxide AgO as additive component) as conductive material and glass powder such as borosilicate lead glass, adding organic vehicle (ethyl cellulose contained butyl cellosolve acetate solution and so on), kneading to form thick film resistor paste, coating the paste on a surface of first protective film 12, and firing the paste at 800-900° C. Thick film resistor 13 is provided with cut groove 17 by laser-trimmer or rubber-cutter etc. and resistance value is adjusted to, for example, ±1% accuracy. Further, resistance value can be controlled to 100 kΩ-10 GΩ, and especially higher resistance value resistor device can be manufactured according to thick film resistor 13.

Electrode caps 14,14 are fitted to both ends of base body 11 and connected to both ends of thick film resistor 13. Lead wires 15,15 are fixed to electrode caps 14,14 by resistance welding etc. and lead wires have a function for connecting between outside circuit and thick film resistor 13. Surfaces of electrode caps 14,14 and thick film resistor 13 are coated with second protective film 16 of such as silicon paint, epoxy paint, etc. and resistance value etc. is displayed on the surface of second protective film 16 (not shown).

According to above-mentioned glazed metal film resistor device, since base body 11 containing glass and thick film resistor 13 of ruthenium oxide as primary component are insulated each other by first protective film 12, which comprises metal oxide film consisting of one or more kinds of metal oxide such as tin oxide etc., glass component contained in base body 11 can be effectively prevented from diffusing into thick film resistor 13. Here, thick film resistor 13 is not affected by glass contained in the base body 11 and can keep good TCR characteristics, which material of the resistor 13 originally has.

Figure 3:
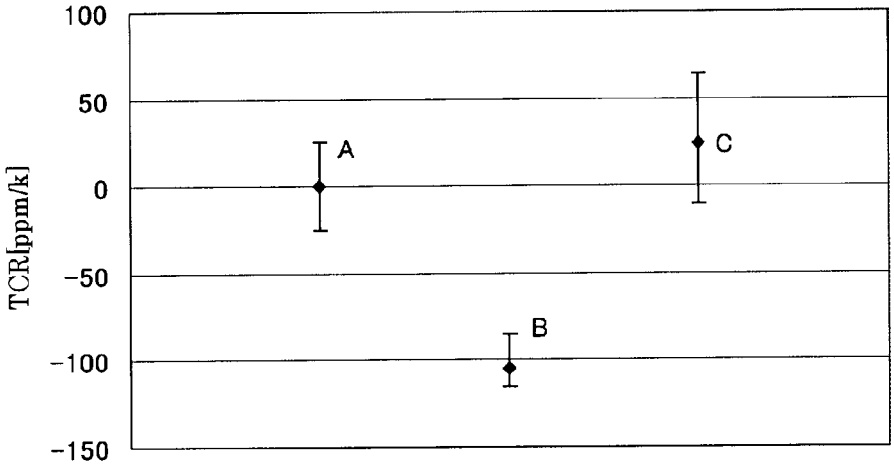
FIG. 3 is a graph showing distributions of TCR values of the resistor device under cases of conditions.

The graph shown in FIG. 3 shows TCR characteristics of the glazed metal film resistor device under cases of conditions. A in the graph shows a distribution of TCR values of ruthenium oxide itself (manufacturer's data), which is contained in thick film resistor paste. B in the graph shows a distribution of TCR values of conventional glazed metal film resistor, which uses an insulator of alumina/glass ratio=80/20 and which does not have the first protective film of metal oxide film. As shown in the graph, contrary that the TCR values of the ruthenium oxide itself (A) distribute close to 0 ppm/K, the TCR values of the conventional glazed metal film resistor (B) shift to distribute close to −100 ppm/K by affection of diffusion of glass contained in the base body 11.

Contrary to this, C in the graph shows a distribution of TCR values of the glazed metal film resistor of the present invention, which uses an insulator containing glass of alumina/glass ratio=80/20 and which has first protective film 12 of metal oxide film. As shown in the graph, TCR values of the glazed metal film resistor of the present invention (C) distribute close to +25 ppm/K, that is, minus direction shift of the TCR values of the glazed metal film resistor 13 by affection of glass contained in base body 11 is effectively prevented by first protective film 12.

Figure 4A:
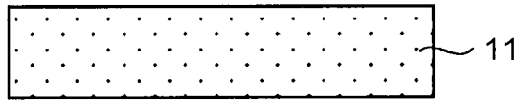
FIG. 4A through 4F are cross-sectional views showing steps of manufacturing the resistor device of the present invention.

Next, method of manufacturing glazed metal film resistor of present invention will be described referring to FIG. 4A through 4F. First, insulative base body 11 is prepared as shown in FIG. 4A. The base body 11 is a columnar ceramic insulator of alumina etc., and alumina/glass ratio is, for example, 50/50, 80/20 etc., and low cost insulator, which contain much glass, is used.

Figure 4B:
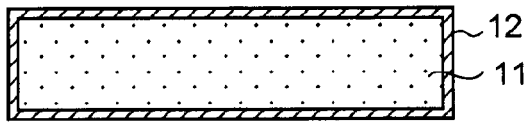

Next, a solution, which comprises tin chloride ($SnCl_4$) 30-85% as primary component for first protective film, metal (Nickel) 0.01-5% solved in hydrochloric acid such as nickel chloride ($NiCl_2.6H_2O$) for improving insulation performance of first protective film, water, ethanol, and others, is prepared. Then, base body 11 is input into a furnace and pre-heated, and the solution is atomized and ejected to base body 11 under environment of 550-850° C. and 1-120 minute(s), and first protective film 12, which comprises tin oxide as primary component and nickel oxide as additive component for improving insulation performance, is formed on entire surface of base body 11 as shown in FIG. 4B. Further, as additive component for improving insulation performance of the first protective film, bismuth oxide can be used other than nickel oxide.

Figure 4C:
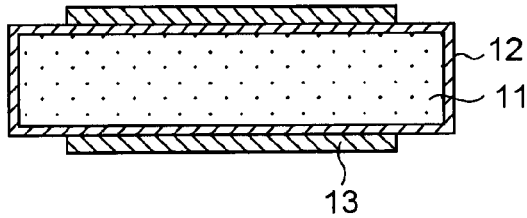

Next, thick film resistor 13 is formed as shown in FIG. 4C by mixing ruthenium oxide $RuO_2$ (or a mixture of ruthenium oxide $RuO_2$ as primary component and silver oxide AgO as additive component) as conductive material and glass powder such as borosilicate lead glass, adding organic vehicle (ethyl cellulose contained butyl cellosolve acetate solution and so on), kneading to form thick film resistor paste, coating surface of base body 11 with the paste, and firing the paste at 800-900° C. to form thick film resistor 13.

Figure 4D:
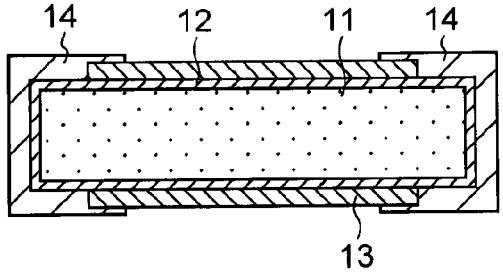
Figure 4E:
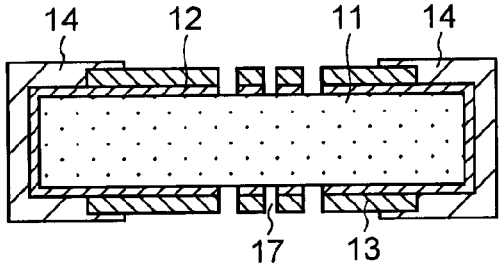

Next, electrode caps 14,14 are fitted on to both ends of base body 11 on which thick film resistor 13 is formed. Accordingly, electrode caps 14,14 and thick film resistor 13 are electrically connected as shown in FIG. 4D. Then, while measuring resistance value between electrode caps 14,14, thick film resistor 13 is cut by laser trimmer etc. to form cut groove 17, and resistance value of the resistor device is adjusted. At this time, a portion of first protective film 12 is cut away with a portion of thick film resistor 13 as shown in FIG. 4E.

Figure 4F:
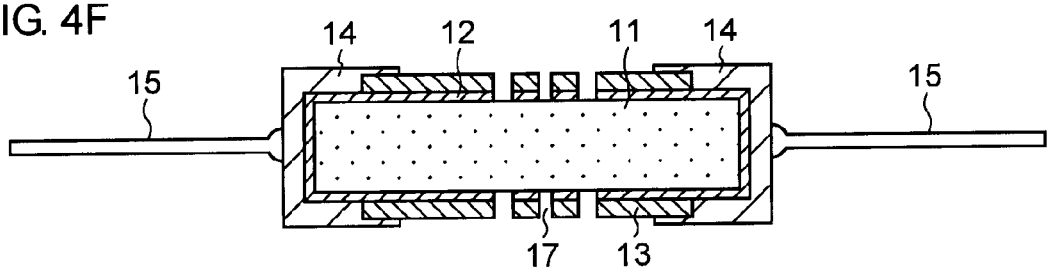

Next, lead wires 15,15 are fixed at both end faces of electrode caps 14,14 by resistance welding etc. as shown in FIG. 4F. Second protective film 16 is formed by coating surfaces of electrode caps 14,14 and thick film resistor 13 with silicon paint or epoxy paint etc., then glazed metal film resistor device as shown in FIG. 1 is finished. Thereafter, printing, which shows resistance value etc, is carried out on surface of second protective film 16, and the resistor device is shipped via characteristics inspection process.

According to the method of manufacturing the glazed metal film resistor device, first protective film 12, which comprises metal oxide of tin oxide as primary component, is formed on surface of base body 11 containing glass by atomizing the solution, which contain tin chloride as primary component and other metal (for example, nickel etc.) as additive component dissolved in hydrochloric acid, and heating. By first protective film 12, glass contained in base body 11 is prevented from diffusing into thick film resistor 13, and, shift of resistance value or TCR value of the glazed metal film resistor device can be prevented.

Further, first protective film 12 of metal oxide film, which comprises tin oxide as primary component and nickel oxide as additive component, has been explained above. However, other protective film, of course, can be used for first protective film 12, which has insulation ability against diffusion of glass contained in the base body 11 to thick film resistor 13. As to method of forming first protective film 12, sputtering method, vacuum-evaporation method, or plating method etc. can be used.

Although certain preferred embodiments of the present invention have been shown and described in detail, it should be understood that various changes and modifications may be made therein without departing from the scope of the appended claims.

What is claimed is:

1. A resistor device comprising:

an insulative base body containing glass;

a first protective film, which does not contain glass, and which comprises a metal oxide film, formed on a surface of said base body; and a thick film resistor containing conductive material and glass formed on said first protective film;

wherein said glass contained in said insulative base body is prevented from diffusing into said thick film resistor.

2. The resistor device according to claim 1, wherein thickness of said first protective film is 0.1 μm or more.

3. The resistor device according to claim 1, wherein said thick film resistor comprises $RuO_2$ as primary component.

4. The resistor device according to claim 1, wherein said first protective film comprises one or more of metal oxide selected from $SnO_2$, $Bi_2O_3$, PbO, AgO, NiO, $SeO_2$, HfO, $Y_2O_3$, ZnO, MgO, $InO_2$, SrO, $Ta_2O_5$, $TeO_2$, CdO, $SiO_2$, $GeO_2$, $GaO_2$, $Al_2O_3$, $ZrO_2$, BaO, and CaO.

5. The resistor device according to claim 1, wherein said first protective film comprises a metal oxide film containing tin oxide as primary component and nickel oxide or bismuth oxide.

6. The resistor device according to claim 1, wherein said base body is a columnar ceramic insulator, which comprises alumina and glass.

7. The resistor device according to claim 6, wherein ratio of alumina/glass of said base body is 50/50, or 80/20.

8. The resistor device according to claim 1, wherein said resistor device has resistance value of higher resistance value region ranging 100 kΩ to 10 GΩ.

9. A method of manufacturing a resistor device comprising:

preparing an insulative base body containing glass;

forming a first protective film of metal oxide on a surface of said base body;

coating a surface of said first protective film with thick film resistor paste containing conductive material and glass, and firing said paste to form a thick film resistor, wherein said first protective film prevents said glass contained in said insulative base body from diffusing into said thick film resistor;

fitting electrode caps on at both ends of said base body, on which said thick film resistor is formed, and connecting said caps to said thick film resistor; and trimming said thick film resistor to adjust resistance value of said resistor device.

10. The method according to claim 9, wherein said first protective film is formed by; atomizing solution containing metal chloride as primary component and metal dissolved in hydrochloric acid to said base body; and heating said base body to form said first protective film, which contains metal oxide as primary component and other metal oxide as additive component.

11. The method according to claim 10, wherein said solution contains tin chloride as primary component and nickel or bismuth dissolved in hydrochloric acid.

12. The method according to claim 9, wherein said base body is a columnar ceramic insulator, which comprises alumina and glass.

13. The method according to claim 12, wherein ratio of alumina/glass of said base body is 50/50, or 80/20.

14. The method according to claim 9, wherein said thick film resistor comprises $RuO_2$ as primary component.

15. The method according to claim 9, wherein said first protective film comprises a metal oxide film containing tin oxide as primary component and nickel oxide or bismuth oxide.

16. The method according to claim 9, wherein said resistor device has resistance value of higher resistance value region ranging 100 kΩ to 10 GΩ.

* * * * *